US010173117B2

(12) United States Patent
Cho

(10) Patent No.: US 10,173,117 B2
(45) Date of Patent: Jan. 8, 2019

(54) BALL-RETURNING NET

(71) Applicant: Kwang Han Cho, Northridge, CA (US)

(72) Inventor: Kwang Han Cho, Northridge, CA (US)

( * ) Notice: Subject to any disclaimer, the term of this patent is extended or adjusted under 35 U.S.C. 154(b) by 0 days.

(21) Appl. No.: 15/398,020

(22) Filed: Jan. 4, 2017

(65) Prior Publication Data

US 2017/0189773 A1 Jul. 6, 2017

Related U.S. Application Data

(60) Provisional application No. 62/274,495, filed on Jan. 4, 2016.

(51) Int. Cl.
*A63B 63/00* (2006.01)
*A63B 71/02* (2006.01)

(52) U.S. Cl.
CPC ..... *A63B 63/00* (2013.01); *A63B 71/022* (2013.01); *A63B 2063/001* (2013.01)

(58) Field of Classification Search
CPC ..... A63B 63/00
USPC ..... 473/432, 478, 400; 273/400, 401
See application file for complete search history.

(56) References Cited

U.S. PATENT DOCUMENTS 5,549,304 A * 8/1996 Davis ..... A63B 63/004 273/396
6,165,085 A * 12/2000 Lubin ..... A63B 63/004 273/400
7,198,274 B2 * 4/2007 Cho ..... A63B 63/004 273/400
7,651,098 B2 * 1/2010 Cho ..... A63B 63/004 273/396
8,308,166 B2 * 11/2012 Cho ..... A63B 63/00 273/401
2004/0038759 A1 * 2/2004 Kuzia ..... A63B 63/00 473/478

* cited by examiner

*Primary Examiner* — Gene Kim
*Assistant Examiner* — Christopher Glenn
(74) *Attorney, Agent, or Firm* — John K. Park; Park Law Firm

(57) ABSTRACT

A ball-returning net comprises a vertical wire frame, a vertical net, a floor wire frame, a slope net, two side barrier nets, and a detachable strap. The vertical net is fixed to the edge portion of the vertical wire frame and blocking the opening of the vertical wire frame. The slope net is disposed over the floor wire frame so as to be tilted from an elevated lower portion of the vertical net to a front edge portion of the floor wire frame, so as to be configured that a ball hitting the vertical net falls down on the slope net and rolls down in a direction of the front edge portion of the floor wire frame. The detachable strap holds the slope net and the vertical wire frame tightly, bending a rear portion of the slope net in a V shape.

11 Claims, 12 Drawing Sheets

BALL-RETURNING NET

REFERENCE TO RELATED APPLICATIONS

This application is a Non-Provisional Application corresponding to and claims priority to U.S. Provisional App. Ser. No. 62/274,495 filed Jan. 4, 2016, which is hereby incorporated by reference.

BACKGROUND OF THE INVENTION

The present invention relates to a ball-returning net.

In many sports, one or more balls are at the center of game. Player's coordinated movements are mainly for controlling the ball or ball's trajectory and other spatial or temporal orbits.

Especially, in practicing the ball games, the player needs to send the ball away from the self. Also, in many cases, the practicing is a job of a single player.

In such situations, the feature of ball-returning gets pretty neat. Such a ball-returning feature can save a lot of time and stress.

Conventional items are available for the purpose, but in most of those cases, there are one or two things that could be much better, considering the structure and performance thereof.

It is going to be great if a ball-returning system be available, which is easy to make, easy to use, and easy to collect balls.

Accordingly, a need for a ball-returning net has been present for a long time considering the expansive demands in the everyday life. This invention is directed to solve these problems and satisfy the long-felt need.

SUMMARY OF THE INVENTION

The present invention contrives to solve the disadvantages of the prior art.

A ball-returning net comprises a vertical wire frame, a vertical net, a floor wire frame, a slope net, two side barrier nets, and a detachable strap.

The vertical wire frame includes an edge portion and an opening enclosed by the edge portion.

The vertical net is fixed to the edge portion of the vertical wire frame and blocking the opening of the vertical wire frame.

The floor wire frame includes an edge portion and an opening enclosed by the edge portion and engaging with the vertical wire frame at along corresponding partial edge portions of the vertical wire frame and the floor wire frame.

The slope net is disposed over the floor wire frame so as to be tilted from an elevated lower portion of the vertical net to a front edge portion of the floor wire frame, so as to be configured that a ball hitting the vertical net falls down on the slope net and rolls down in a direction of the front edge portion of the floor wire frame.

The two side barrier nets are disposed at both sides of the ball-returning net in a triangular shape and configured to block the ball deflected sideways.

The detachable strap holds a middle point of a rear edge portion of the slope net and the lower edge portion of the vertical wire frame tightly, bending a rear portion of the slope net in a V shape.

The vertical net may be disposed tightly so as to form a tight net surface.

The ball-returning net may further comprise a floor net fixed to the edge portion of the floor wire frame and blocking the opening of the floor wire frame.

The rear portion of the slope net may be attached to the vertical wire frame at two side edge portions thereof.

The front portion of the slope net may be attached to a front edge portion of the floor wire frame along an entire length of the front edge portion of the floor wire frame.

The slope net may be formed integrally with the two side barrier nets.

The ball-returning net may further comprise two poles and two straps.

The two poles are disposed tiltingly between the vertical wire frame and the floor wire frame, and the two straps disposed right next to the two poles substantially in parallel.

Each of the two poles has two or more segments to be assembled and each of the two poles performs a function of keeping the vertical wire frame and the floor wire frame from collapsing and being closed and folded and thus keeping the angle between the vertical wire frame and the floor wire frame at the substantially right angle.

And the two straps performs a function to hold the segments of the two poles together.

The ball-returning net may further comprise a detachable target sheet disposed in front of the vertical net with a predetermined gap vertically or tiltingly with a top edge portion attached to a top edge portion of the vertical wire frame.

A bottom edge portion of the detachable target sheet may be attached to the two side edge portions of the vertical wire frame.

The ball-returning net may further comprise a center strap line extending from a middle point of the front edge portion of the floor wire frame to the middle point of the rear edge portion of the floor wire frame, and the center strap has a color different from a color of surrounding parts.

The ball-returning net may further comprise two parallel guide lines, each of which extending from the front edge portion of the floor wire frame partially toward the rear edge portion of the rear edge portion of the slope net.

The ball-returning net may further comprise a ball stopper mesh having a lower edge portion attached to the front edge portion of the floor wire frame and two side edge portions attached to the lower portions of the two side barrier portions, so as to be configured to stop the ball rolling down on the declined surface of the slope net.

The advantages of the present invention are: (1) the ball-returning net according to the invention provides a simple structure for performing the purposes; and (2) the ball-returning net according to the invention provides a sturdy structure using a minimal number of components.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Figure 1:
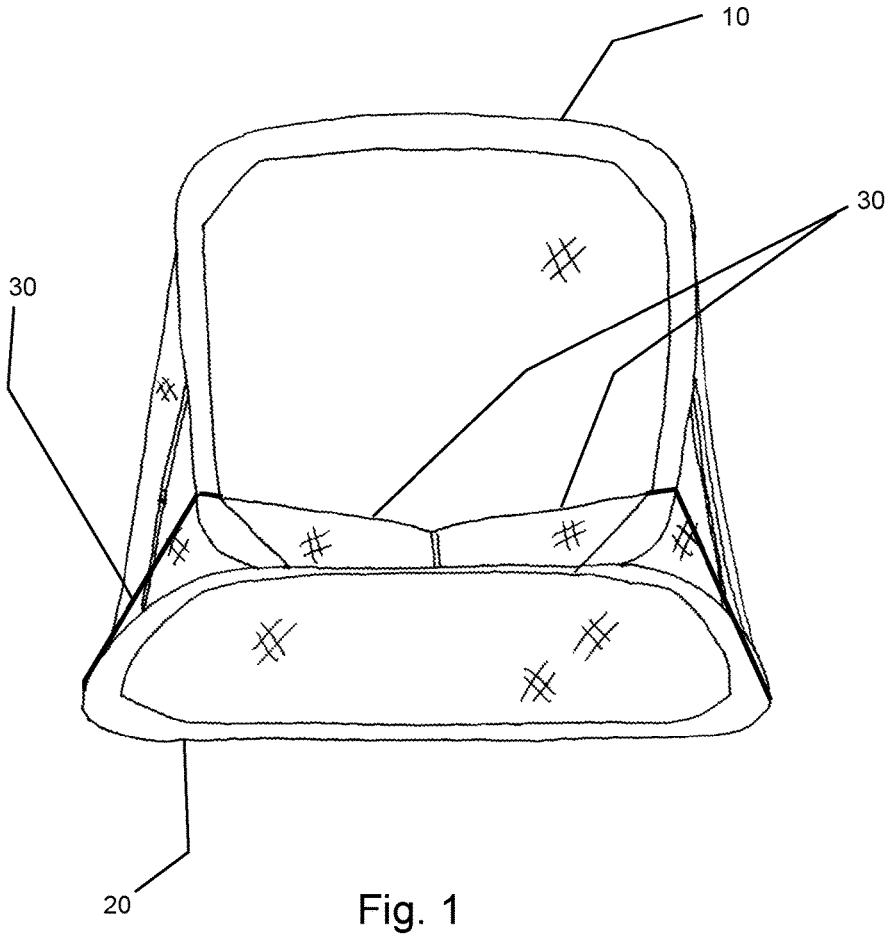
FIG. 1 is a perspective front view showing a ball-returning net according to an embodiment of the invention.

Referring to the figures, the embodiments of the invention are described in detail.

A ball-returning net according to an embodiment of the invention comprises a vertical frame (10), a ground frame (20), a return sheet (30), two side panel nets (40), two poles (50), two straps (60), and a target (70).

Figure 2:
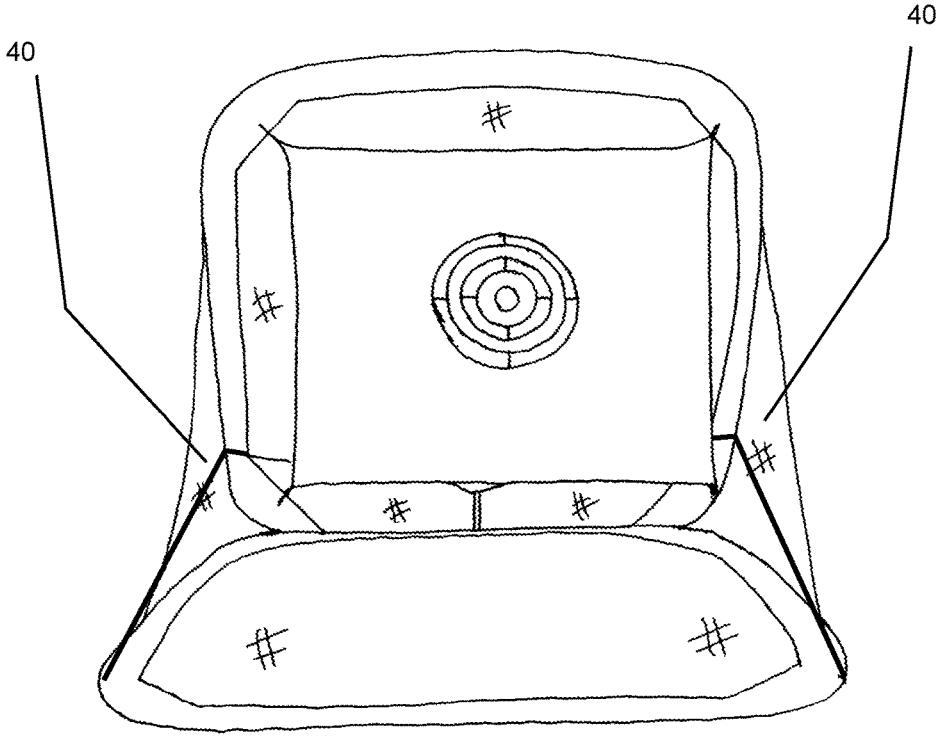
FIG. 2 is another perspective front view showing a ball-returning net according to another embodiment of the invention.
Figure 3:
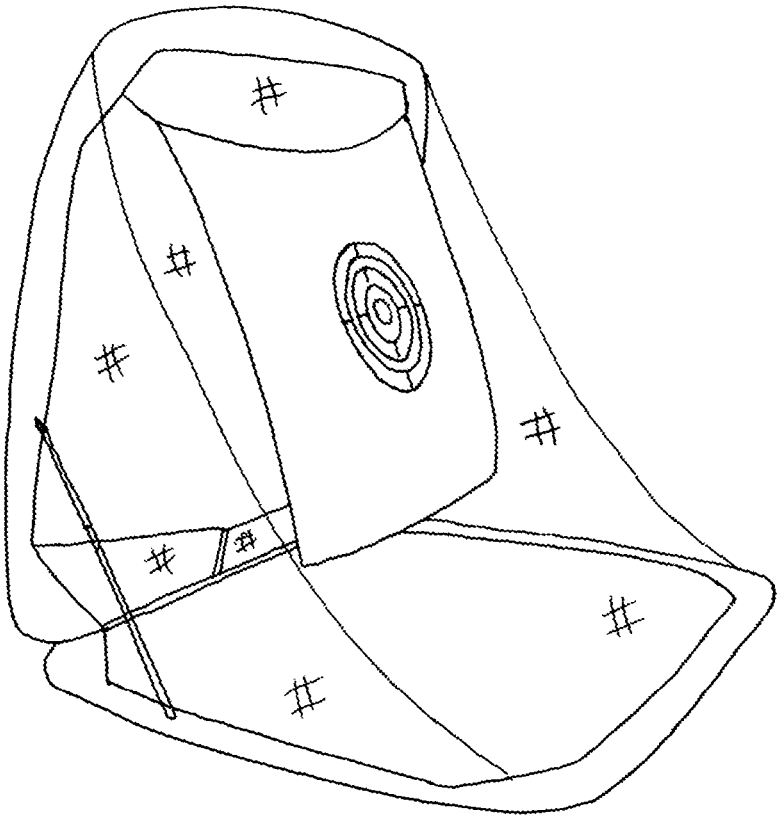
FIG. 3 is a perspective view showing a ball-returning net of FIG. 2.

As shown in FIGS. 1 and 2, the vertical frame (10) is installed in an upright position on the ground, and the ground frame (20) is disposed on the ground.

Figure 4:
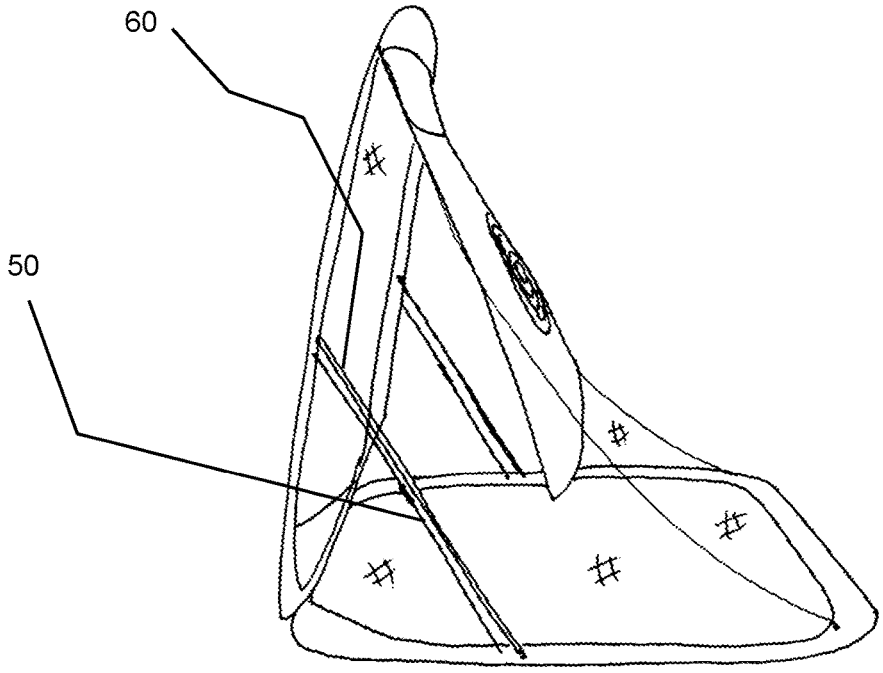
FIG. 4 is a perspective side view showing of FIG. 2.

As illustrated, the vertical frame (10) and the ground frame (20) are connected along corresponding edges. As shown in FIG. 4, the vertical frame (10) and the ground frame (20) meet each other at the corresponding edges substantially by a right angle. In the illustrated embodiment, the angle is a little less that 90 degrees.

Each of the vertical frame (10) and the ground frame (20) may comprise a collapsible loop and a fabric wrap. The collapsible loop is not seen directly because it is hidden under the fabric.

In certain embodiment, the vertical frame (10) may further comprise a net disposed over the opening defined by the collapsible loop and the fabric. Usually, the gap defined by the ground frame (20) is left as opened.

The return sheet (30) is provided as a net disposed so as to be attached to a certain height of the vertical frame (10) and then to a far edge of the ground frame (20), so as to be disposed declined from the vertical frame (10) toward the end of the ground frame (10). A ball propelled toward the vertical frame (10) would be stopped by the net disposed over the opening of the vertical frame (10) or the target (70) installed in front of the vertical frame (10), and then go back to the direction where it flied in by being guided on or rolling along the declined net of the return sheet (30).

The two side panel nets (40) are attached or sewed to the side edges of the vertical frame (10) and the return net (30), so as to prevent balls from flying off sideways.

In certain embodiments, the two side panel nets (40) may be attached or sewed to the fabric portion at the side edges of the vertical frame (10).

In certain embodiments, the two side panel nets (40) may be provided integrally with the return sheet (30).

The two poles (50) are disposed tiltingly between the vertical frame (10) and the ground frame (20). Each of the two poles (50) may have two or more segments to be assembled. The two poles (50) performs a function of keeping the vertical frame (10) and the ground frame (20) from collapsing and being closed and folded and thus keeping the angle between the vertical frame (10) and the ground frame (20) at the substantially right angle.

The two straps (60) are disposed right next to the two poles (50), usually in parallel. The two straps (60) performs a function to hold the segments of the two poles (50) together. Usually, the segments of the pole (50) are disassembled by a stretching force, and the strap (60) provides another force in a counter direction to the stretching direction. In certain embodiments, the strap (60) is made of an elastic material.

Either end of the pole (50) or the strap (60) may be fixed or provided detachably to the corresponding fabric portion of the vertical frame (10) and the ground frame (20).

Figure 5:
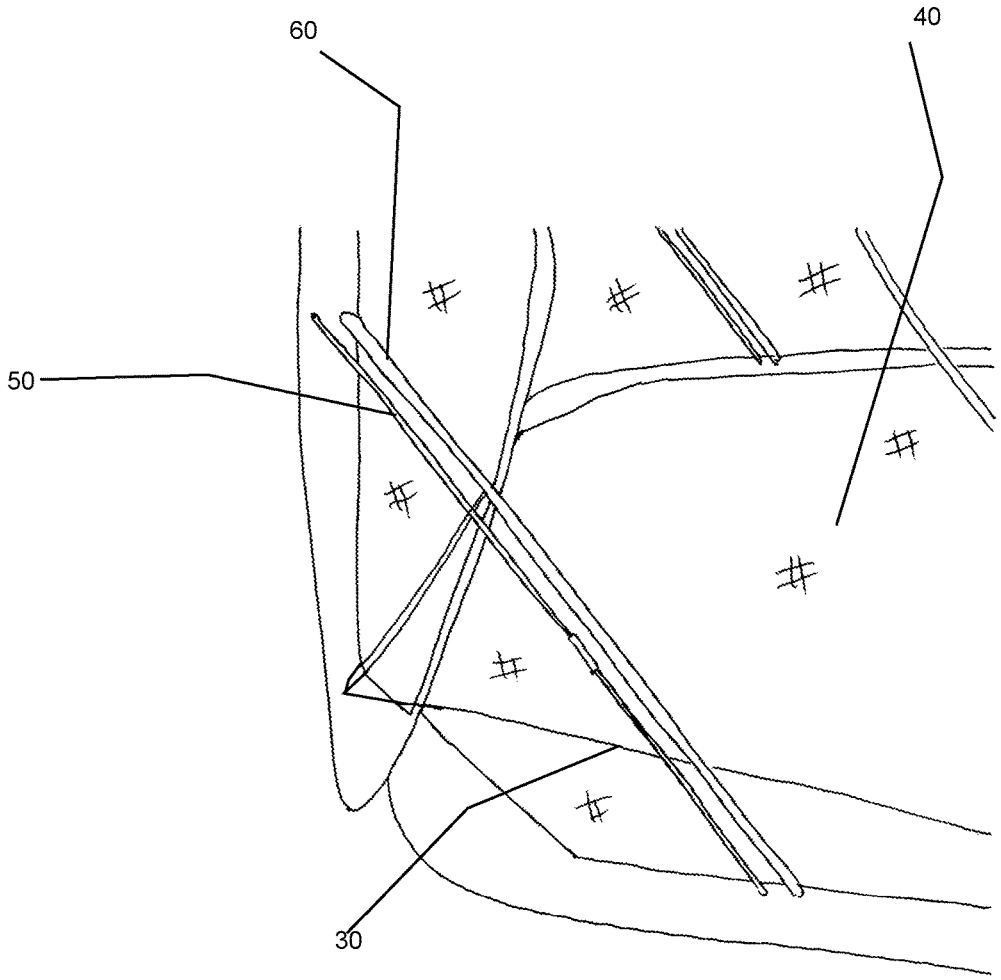
FIG. 5 is an exploded perspective side view showing of FIG. 4.

The details of structures of the pole (50), the strap (60), and how the vertical frame (10) and the ground frame (20) meet each other can be seen in FIG. 5.

Figure 6:
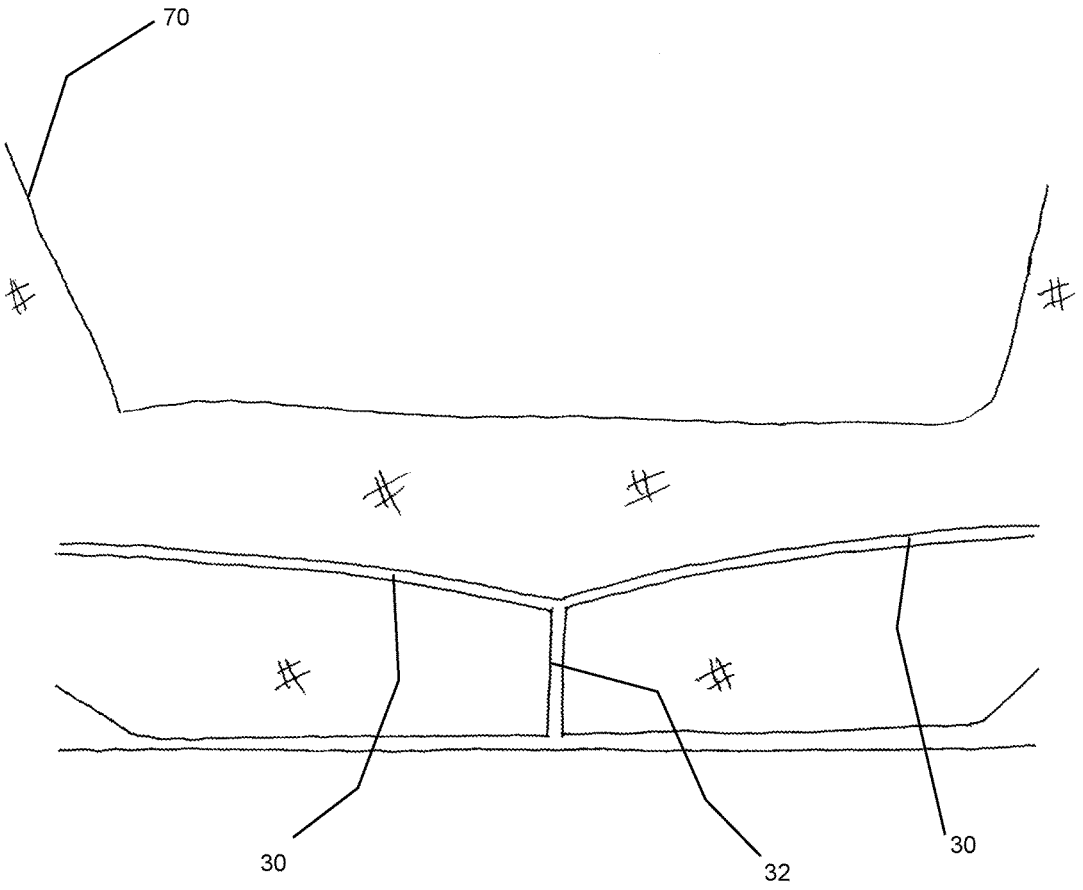
FIG. 6 is a perspective rear view showing of FIG. 2.
Figure 7:
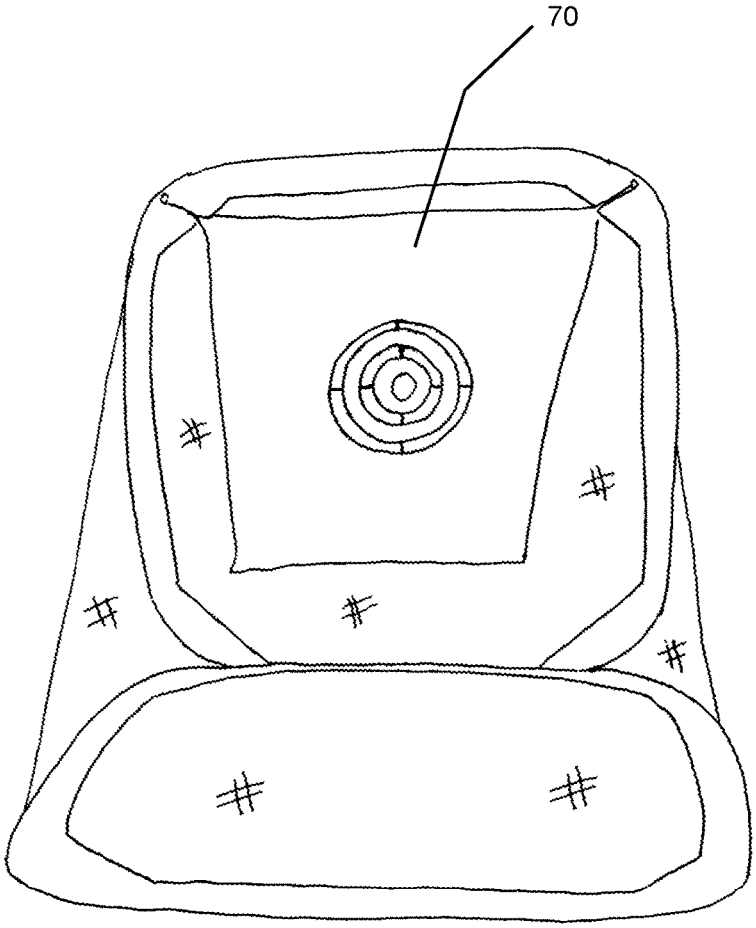
FIG. 7 is another perspective front view showing the ball-returning net of FIG. 2.
Figure 8:
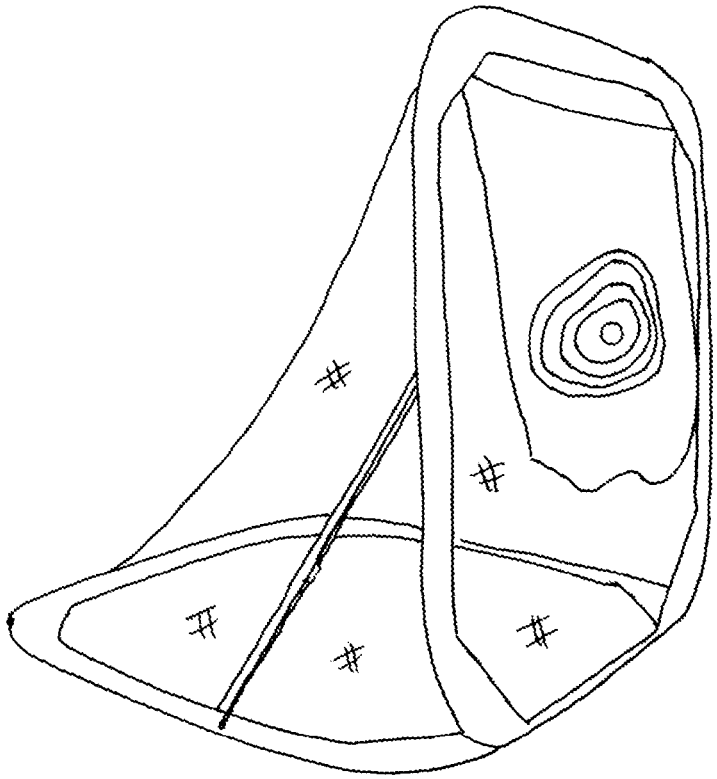
FIG. 8 is a perspective rear view showing the ball-returning net of FIG. 2.

In FIG. 6, the return sheet (30) is further attached to a bottom edge of the vertical frame (10) by a short detachable strap (32). Usually, the return sheet (30) are attached to at a certain height of the side edges of the vertical frame (10) as shown in FIG. 5, but it can be held in place further by the short detachable strap (32).

Figure 9:
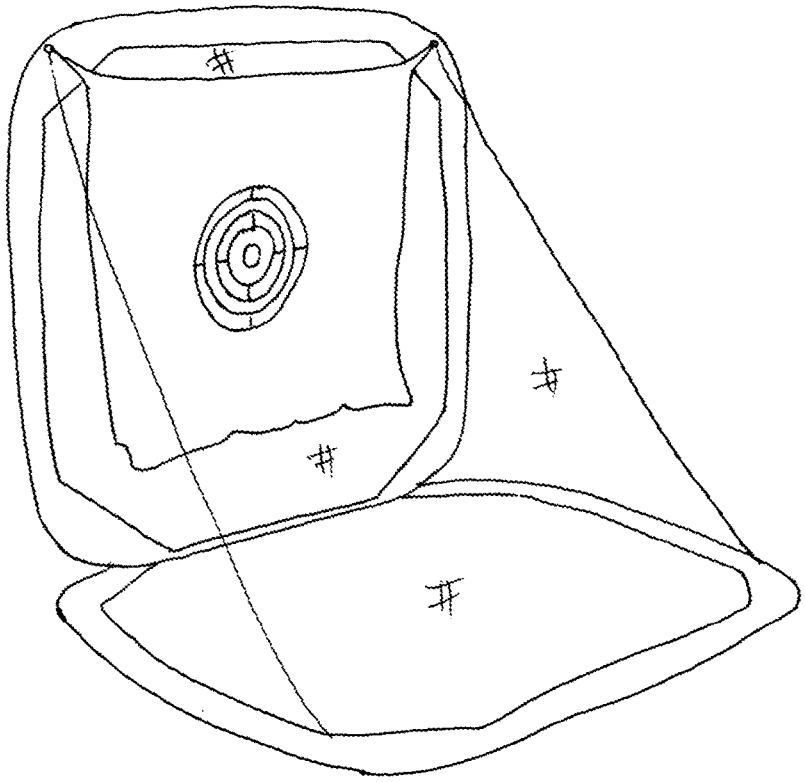
FIG. 9 is still another perspective front view showing the ball-returning net of FIG. 2.

In certain embodiments, the ball-returning net may further comprise a plurality of pegs (orange things in FIG. 9) for fixing the ball-returning net to the ground securely.

In other figures, the details of the structures can be seen clearly.

Figure 10:
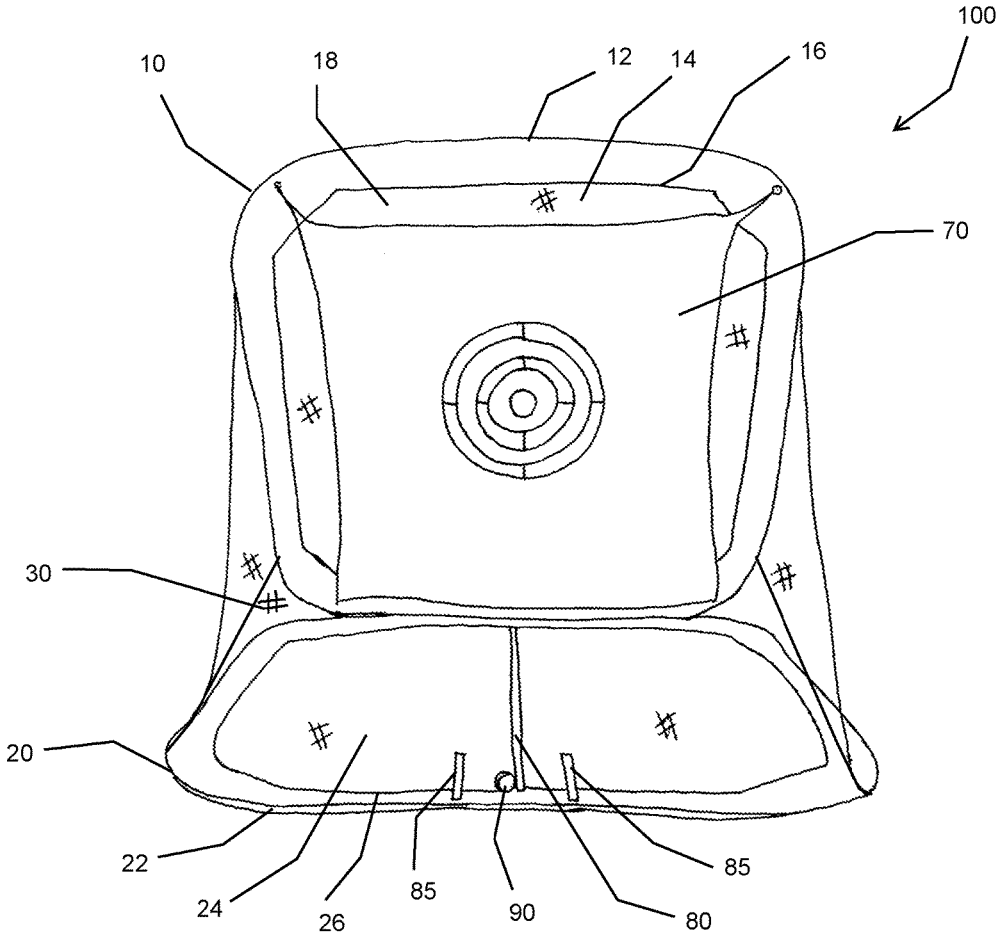
FIG. 10 is a front view showing a ball-returning net according to another embodiment of the invention.
Figure 11:
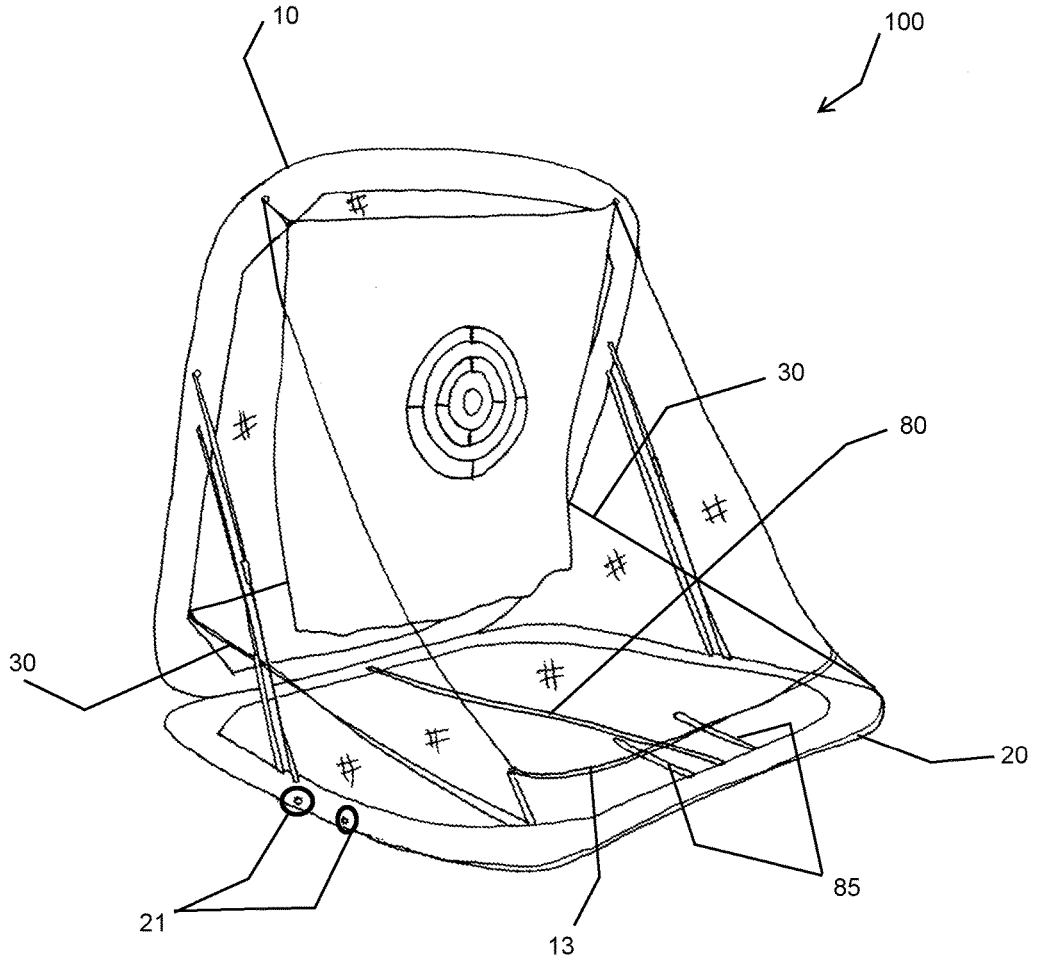
FIG. 11 is a perspective view showing the ball-returning of FIG. 10.
Figure 12:
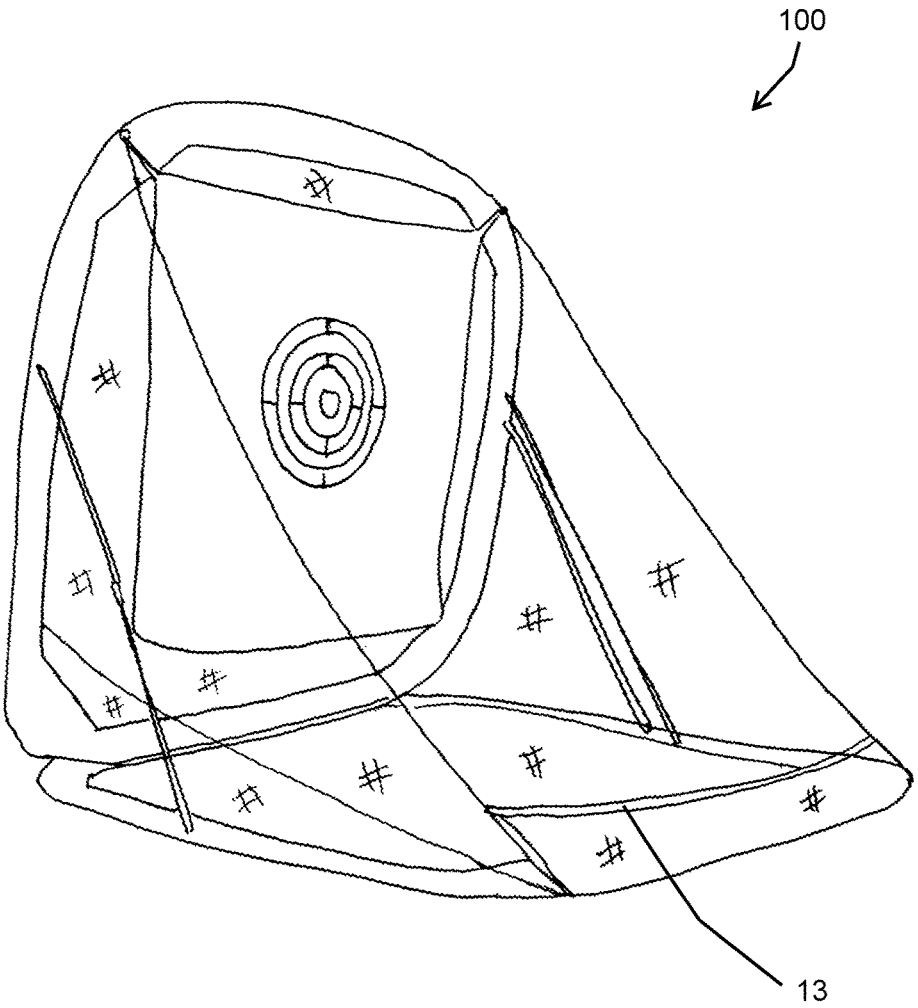
FIG. 12 is another perspective view showing a ball-returning according to still another embodiment of the invention.

An aspect of the invention provides a ball-returning net as shown in FIGS. 10-12.

The ball-returning net (100) comprises a vertical wire frame (10), a vertical net (18), a floor wire frame (20), a slope net (30), two side barrier nets (40), and a detachable strap (32) as shown in FIGS. 10 through 12.

The vertical wire frame (10) includes an edge portion (12) and an opening (14) enclosed by the edge portion.

The vertical net (18) is fixed to the edge portion (12) of the vertical wire frame (10) and blocking the opening (14) of the vertical wire frame (10).

As illustrated, the edge portion (12) may be connected with the vertical net (18) through a fabric flange (16). That is, the vertical wire frame (10) is queued through the fabric flange (16).

The floor wire frame (20) includes an edge portion (22) and an opening (24) enclosed by the edge portion (22) and engaging with the vertical wire frame (10) at along corresponding partial edge portions of the vertical wire frame (10) and the floor wire frame (20).

Similarly as in the vertical wire frame (10), the edge portion (22) and the opening (24) are connected to each other through the fabric flange (26).

The slope net (30) is disposed over the floor wire frame (20) so as to be tilted from an elevated lower portion of the vertical net (18) to a front edge portion of the floor wire frame (20), so as to be configured that a ball hitting the vertical net (18) falls down on the slope net (30) and rolls down in a direction of the front edge portion of the floor wire frame (20) as shown in FIG. 10.

The two side barrier nets (40) are disposed at both sides of the ball-returning net (100) in a triangular shape and configured to block the ball deflected sideways. Also, each of the two side barrier nets (40) has a vertical side, a floor side, and a diagonal side, and the vertical side is attached to the vertical wire frame (10) or its fabric flange (16), and the floor side is attached to the floor wire frame (20) or its fabric flange (26) as illustrated in FIGS. 10-12. The attaching may be achieved through sewing or other conventional fastening methods between net and fabric.

The detachable strap (32) holds a middle point of a rear edge portion of the slope net (30) and the lower edge portion of the vertical wire frame (10), or the combined structure of the vertical wire frame (10) and the floor wire frame (20), tightly, bending a rear portion of the slope net (30) in a V shape as shown in FIG. 6.

The vertical net (18) may be disposed tightly so as to form a tight net surface, so as to facilitating stopping the ball further.

The ball-returning net (100) may further comprise a floor net (not shown) fixed to the edge portion (22) of the floor wire frame (20) and blocking the opening (24) of the floor wire frame (20) just as in the case of the vertical wire frame (10).

The rear portion of the slope net (30) may be attached to the vertical wire frame (10) at two side edge portions thereof as shown at least in FIG. 10.

The front portion of the slope net (30) may be attached to a front edge portion of the floor wire frame (20) along an entire length of the front edge portion of the floor wire frame (20).

The slope net (30) may be formed integrally with the two side barrier nets (40).

The ball-returning net (100) according to the invention may further comprise two poles (50) and two straps (60) as shown in FIGS. 4 and 5.

The two poles (50) are disposed tiltingly between the vertical wire frame (10) and the floor wire frame (20), and the two straps (60) disposed right next to the two poles (50) substantially in parallel.

Each of the two poles (50) has two or more segments to be assembled and each of the two poles (50) performs a function of keeping the vertical wire frame (10) and the floor wire frame (20) from collapsing and being closed and folded and thus keeping the angle between the vertical wire frame (10) and the floor wire frame (20) at the substantially right angle. Furthermore, the ball-returning net (100) according to the invention may further comprise one or two eyelets (21) on each of the side edge portion of the floor wire frame (20) or its fabric flange (26) as shown in FIG. 11, so that one of the two poles (5) can be inserted. That way, the angle between the vertical wire frame (10) and the floor wire frame (20) can be adjusted.

And the two straps (60) performs a function to hold the segments of the two poles (50) together.

The ball-returning net (100) according to the invention may further comprise a detachable target sheet (70) disposed in front of the vertical net (18) with a predetermined gap vertically or tiltingly with a top edge portion attached to a top edge portion of the vertical wire frame (10) as shown in FIGS. 10-12.

A bottom edge portion of the detachable target sheet (70) may be attached to the two side edge portions of the vertical wire frame (10).

The ball-returning net (100) according to the invention may further comprise a center strap line (80) extending from a middle point of the front edge portion of the floor wire frame (20) to the middle point of the rear edge portion of the vertical wire frame (10), and the center strap (80) has a color different from a color of surrounding parts as shown in the figures, facilitating the user of the net to see the line of movement of the ball (90) with respect to the center strap (80) as a reference.

The ball-returning net (100) according to the invention may further comprise two parallel guide lines (85), each of which extending from the front edge portion of the floor wire frame (20) partially toward the rear edge portion of the rear edge portion of the slope net (30) as shown in FIGS. 10-12.

The ball-returning net (100) according to the invention may further comprise a ball stopper mesh (13) having a lower edge portion attached to the front edge portion of the floor wire frame (20) and two side edge portions attached to the lower portions of the two side barrier portions (40), so as to be configured to stop the ball rolling down on the declined surface of the slope net (30).

While the invention has been shown and described with reference to different embodiments thereof, it will be appreciated by those skilled in the art that variations in form, detail, compositions and operation may be made without departing from the spirit and scope of the invention.

What is claimed is:

1. A ball-returning net comprising: a vertical wire frame including an edge portion and an opening enclosed by the edge portion, wherein the edge portion comprises a lower edge portion; a vertical net fixed to the edge portion of the vertical wire frame and blocking the opening of the vertical wire frame; a floor wire frame configured to be disposed on a floor and including an edge portion and an opening enclosed by the edge portion, wherein the edge portion comprises a rear edge portion, and wherein the lower edge portion of the vertical wire frame engages the rear edge portion of the floor wire frame, so that the engaged edge portions of the vertical wire frame and the floor wire frame are configured to be on the floor; a slope net disposed over the floor wire frame so as to be tilted from an elevated lower portion of the vertical net to a front edge portion of the floor wire frame, so as to be configured that a ball hitting the vertical net falls down on the slope net and rolls down in a direction of the front edge portion of the floor wire frame; two side barrier nets disposed at two sides of a ball-returning net in a triangular shape and configured to block the ball deflected sideways; and a detachable strap holding tightly a middle point of a rear edge portion of the slope net and a middle point of the lower edge portion of the vertical wire frame together, bending the rear edge portion of the slope net in a single V shape over an entire length of the rear edge portion of the slope net on a vertical plane defined by the edge portion of the vertical wire frame.

2. The ball-returning net of claim 1, wherein the vertical net is disposed tightly so as to form a tight net surface.

3. The ball-returning net of claim 1, wherein the rear edge portion of the slope net is attached to the vertical wire frame at two side edge portions thereof.

4. The ball-returning net of claim 3, wherein the front portion of the slope net is attached to a front edge portion of the floor wire frame along an entire length of the front edge portion of the floor wire frame.

5. The ball-returning net of claim 1, wherein the slope net is formed integrally with the two side barrier nets.

6. The ball-returning net of claim 1, further comprising: two poles disposed tiltingly between the vertical wire frame and the floor wire frame; and two straps disposed right next to the two poles substantially in parallel, wherein each of the two poles has two or more segments to be assembled and each of the two poles performs a function of keeping the vertical wire frame and the floor wire frame from collapsing and being closed and folded and thus keeping an angle between the vertical wire frame and the floor wire frame at a substantially right angle, and wherein the two straps performs a function to hold the segments of the two poles together.

7. The ball-returning net of claim 1, further comprising a detachable target sheet disposed in front of the vertical net with a predetermined gap vertically or tiltingly with a top edge portion attached to a top edge portion of the vertical wire frame.

8. The ball-returning net of claim 7, wherein a bottom edge portion of the detachable target sheet is attached to two side edge portions of the vertical wire frame.

9. The ball-returning net of claim 1, further comprising a center strap line extending from a middle point of the front edge portion of the floor wire frame to a middle point of the rear edge portion of the floor wire frame, wherein the center strap has a color different from a color of surrounding parts.

10. The ball-returning net of claim 1, further comprising two parallel guide lines, each of which extending from the front edge portion of the floor wire frame partially toward the rear edge portion of the slope net.

11. The ball-returning net of claim 1, further comprising a ball stopper mesh having a lower edge portion attached to the front edge portion of the floor wire frame and two side edge portions attached to lower portions of the two side barrier nets, so as to be configured to stop the ball rolling down on a declined surface of the slope net.

* * * * *